US005133107A

United States Patent [19]

MacDonald

[11] Patent Number: 5,133,107

[45] Date of Patent: Jul. 28, 1992

[54] FOAM TYPE CARPET CLEANER

[76] Inventor: Donald A. MacDonald, 21 Eccleston Dr. Apt. 10, North York, Ontario, Canada, M4A 1K4

[21] Appl. No.: 649,982

[22] Filed: Feb. 4, 1991

[30] Foreign Application Priority Data

Jul. 4, 1990 [CA] Canada ..... 2020451

[51] Int. Cl.[5] ..... A47L 11/03

[52] U.S. Cl. ..... 15/50.3; 15/320

[58] Field of Search ..... 15/320, 50.3, 50.1

[56] References Cited

U.S. PATENT DOCUMENTS

| | | | |
|---|---|---|---|
| 3,258,803 | 7/1966 | Wolter et al. | 15/320 X |
| 3,370,315 | 2/1968 | MacFarland et al. | 15/320 |
| 3,606,631 | 9/1971 | Vassh et al. | 15/50.1 X |
| 3,751,747 | 8/1973 | Blaeldh | 15/321 X |
| 4,507,819 | 4/1985 | Martinec | 15/50.3 X |
| 4,829,624 | 5/1989 | Lackner et al. | 15/320 |

*Primary Examiner*—Chris K. Moore

[57] ABSTRACT

The invention is directed to improvements in foam type carpet cleaners and, more particularly, to the production of a relatively dry water-detergent mixture foam which is producted by applying drops of the mixture into an airstream duct in which is located a rotating propeller, or fan blade, driven by the airstream, the propeller contacting the drops and producing a fine droplet dispersion of the mixture, which dispersion is blown, by the same air stream, through a fine mesh screen to produce a foam which is applied, to a carpet to be cleaned, by a foam spreader. The foam is then brushed through the nap of a carpet by a rotating brush associated with the spreader. A debris collector is preferably associated with the brush to pick up carpet debris and spent foam.

7 Claims, 1 Drawing Sheet

FOAM TYPE CARPET CLEANER

FIELD OF THE INVENTION

The present invention relates to a carpet cleaner of the type which produces foam and supplies it to the nap of a carpet and then brushes the foam through the nap of the carpet to clean same. This is the, so called, shampooing type of carpet cleaner which utilizes a mixture of water and detergent as the substance from which the foam is produced. The foam per se is comprised by so called soap bubbles and a "dry" foam is made up of soap bubbles to which little or no excess moisture adheres. The invention relates more particularly to an economical and efficient means for producing a "dry" foam and utilizing same for cleaning.

BACKGROUND OF THE INVENTION

The use of carpets for floor coverings has greatly increased in recent years and the need for economical and efficient means for cleaning, especially by the home owner, has increased simultaneously. This need has resulted in the development of foam type carpet cleaners which either do not produce foam in an efficient manner or produce a foam that is too wet with the result that the cleaned carpet requires an extended drying time.

For instance, French Pat. No. 2,031,395 produces a foam by means of an air bubbler 14 immersed in a mixture of detergent and water, bubbles from which rise through the mixture to produce a foam at the surface thereof which is blown onto a carpet beater roller 23 which applies the foam to the carpet which is then brushed by brushes 24 and twenty five.

U. S. Pat. No. 3,843,989 describes another system in which the mixture of water and detergent is applied to a sponge covered roller 11 and a brush 14 brushes the mixture off the roller and onto the carpet. The action of brushing the sponge produces the foam in this instance.

Neither of the above two patented systems produces a dry foam since the foam forming processes used are not efficient and an unacceptable wetting of the carpet occurs.

A device to overcome this defect is illustrated in the present applicant's prior Canadian Pat. No. 924,064 wherein the foam producing means is constituted by a venturi-jet system for breaking up the water detergent mixture into fine droplets which are blown through a fine screen to produce a relatively dry foam which is applied to the carpet for cleaning by, for instance, a standard rug vacuum-beater system.

OBJECTS OF THE INVENTION

It is an object of the present invention to provide a foam-type carpet cleaning device which is highly efficient, economical to manufacture and simple to operate so that it may be effectively employed by the average home owner.

It is a further object of this invention to provide a foam-type carpet cleaning device which produces a very dry foam in order that the carpet will not be unduly wetted by the cleaning process.

SUMMARY OF THE INVENTION

In accordance with the present invention a carpet cleaning device is provided which produces a very dry foam, applies it to the carpet wherefrom it is brushed off along with soil particles and carpet discoloring elements. In a particular feature of the invention and in order to achieve very fine bubbles of the detergent mixture, which will produce a dryer foam, a rotating disperser, in the form of an air driven rotating propeller, is positioned in an air-stream duct and droplets of the water and detergent mixture are applied to the rotating element which disperses the mixture into fine droplets which are blown, by the same air stream, through a fine mesh screen to form a very fine foam bubble substantially without excess water. The foam is blown by the same air stream through a multi-apertured foam spreading container onto a carpet to be cleaned. A rotating carpet cleaning brush, preferably driven by a motor which also supplies the air stream for producing the foam, brushes the foam into and through the upper ends of the carpet nap to effect a cleaning action. The brush is preferably associated with a debris container in such a manner that the debris from the carpet is brushed into the container which container may be emptied as required.

DETAILED DESCRIPTION OF THE INVENTION

Figures 1, 2:
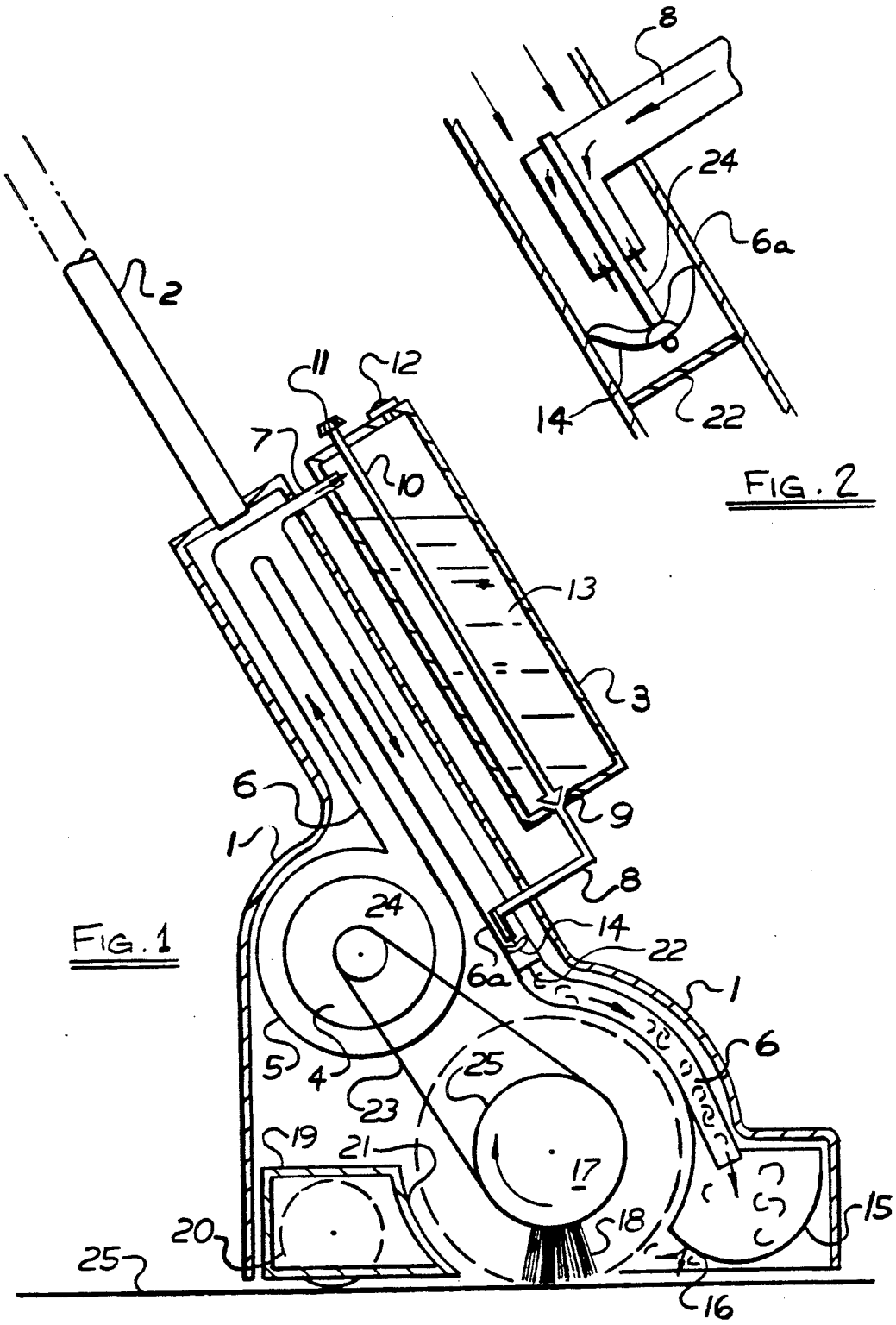
FIG. 1 shows a foam-type carpet cleaning device in accordance with the present invention.
FIG. 2 shows an enlarged view of a the water detergent droplet producing and dispersing unit which is a particular feature of the invention.

Referring to FIG. 1 of the drawings the foam-type carpet cleaning device is shown as comprising, an optional housing 1 having a manual handle element 2 and a tank 3 in which is stored a supply of a water-detergent mixture 13. The housing is provided with, at least, a set of rear wheels 20 to facilitate its movement over a floor carpet 25. An electric motor 4, within the housing 1, is provided with a pulley 24 which, by means of a belt 23, drives a carpet brush 17 and, also, with a turbine type fan 5 which is operated by the motor 4 to provide an air-stream to air duct 6. Duct 6 provides air-stream pressure to the top of tank 13 by an auxiliary duct 7 which may be used to pressure the water-detergent mixture or merely to compensate for the vacuum which would be produced as liquid is drawn off. It should be noted here that it is not essential to provide air to tank 13 since a port, for instance in a cap 12, may suffice to relieve any vacuum produced by the removal of mixture therefrom. Air duct 6 is turned back on itself to provide an air-stream passage **6*a* downward to a foam spreader 16** which will be more fully described later.

Tank 13 is provided with a liquid dispensing valve 9 which is controlled by a shaft 10 on the upper end of which is provided a turning knob 11. Threads for the adjustment of the valve 9 may be provided in the top end of the tank 13 where the shaft 10 passes therethrough. Connected with valve 9 is a liquid duct 8 which feeds water-detergent mixture, as best shown in FIG. 2, to a drip orifice below which is positioned an air-stream driven propeller or fan 14 mounted on a shaft 24 located centrally of duct 6. The purpose of the propeller is to convert the drops of mixture to small droplets when the drops, from the orfice, impinge on the rotating propeller. A fine mesh screen 22 is mounted immediately below the propeller 14. The mesh openings must be small enough to prevent the small droplets being blown therethrough without forming small bubbles. The mesh may be of metal, synthetic material or a coarsely woven cloth. In practice a thin terry cloth has been found very effective in producing foaming or bubbling.

It is to be noted here that the droplet dispersing fan is preferably provided with a concave blade structure facing the air stream or opposed to the direction of air flow. It has been discovered that with such a concave structure the water droplets are converged or focussed more centrally of duct 6 and much less duct wall contact is made by the droplets. In this manner the droplets are prevented, for the greater part, from coalescing to form larger droplets on the inner surface of the duct. Larger droplets are not conducive to forming a relatively dry foam. The shape of the blade, to provide the rotational movement, is somewhat optional. However, a high speed of rotation is desired in order to produce fine droplets.

Duct 6 continues downward to terminate, open ended, in a foam spreader 15 which is closed except for a plurality of apertures 16 through which foam may be blown onto a carpet 25. The total area of the apertures provided in foam spreader 15 must be such as to allow sufficient air passage to produce the propeller rotation and foam formation desired.

Associated with the foam spreader 16 and rotating brush 17, provided with bristles 18, is a debris collector pan 19 provided with an upwardly inclined and reentrant front side, facing the brush, so that debris deposited therein by the brush action will be retained. This collector has the added advantage that any moisture droplets produced in the brushing of the floor will be retained in container 19 thus contributing to a drier cleaning of a carpet.

In operation of the carpet cleaning device, according to the present invention, the air-stream flow, the droplet producing propeller's rotational speed and the quantity of and size of water-detergent mixture drops fed to the propeller and screen must be balanced to produce the driest foam possible. This balance can be achieved by a trial and error method. It should be noted here that a relatively modest sized motor may be employed since air-stream flow required is modest and the main requirement is power to operate the carpet brush per se.

The embodiment of the invention described herein is to be considered primarily as being illustrative of the principles of operation involved in the foam-type carpet cleaning device and that variations therefrom, which do not depart from the spirit and scope of the present invention, are covered by the appended claims.

I claim:

1. A foam type carpet cleaner comprising motor means to drive a carpet cleaning brush and fan means for producing an air-stream, air duct means for conveying the air-stream to a foam spreader, moving-air driven rotatable fan mounted for rotation in the duct and adapted to be driven by the air-stream, means to supply drops of a foamable mixture to the duct, upstream of the fan to impinge on said fan and be converted into fine mixture droplets, foam producing screen means located in the duct downstream of the fan through which the droplets are blown by the air-stream to produce a foam, said foam being conveyed by the duct to the foam spreader whereby the foam is applied to a carpet, to be cleaned, and brushed thereover by the carpet cleaning brush.

2. The carpet cleaning device, as claimed in claim 1, wherein the fan is provided with blades which are formed with a concave face overall, which face is opposed to the direction of the air-stream.

3. The carpet cleaner, as claimed in claims 1 or 2, wherein the screen mesh is sufficiently fine as to produce small air bubbles of the mixture resulting in a dry foam conglomulate.

4. The carpet cleaner, as claimed in claim 1 or 2, wherein the carpet cleaning brush is associated with a debris collector into which foam and debris from the carpet are swept during a cleaning operation.

5. A foam type carpet cleaning device comprising, motor driven air-stream producing means and rotatable carpet cleaning brush means, an air-stream duct for conveying the air-stream to a foam spreader, means to supply drops of a water and detergent foam producing mixture to an air-stream driven rotating fan means to be dispersed thereby into small mixture droplets, soap bubble producing means located downstream of the fan means to convert the droplets into a foam, which foam is conveyed, by the air-stream, to the foam spreader, the foam spreading container, closely associated with the carpet cleaning brush, being provided with apertures adapted to spread foam on a carpet to be cleaned by the brush.

6. The carpet cleaner, as claimed in claim 5, wherein the fan means presents a concave face opposed to the direction of the air-stream whereby the droplets are, for the most part, maintained centrally of the duct.

7. The carpet cleaner, as claimed in claim 5 or 6, wherein the bubble producing screen mesh size is adapted, in conjunction with the air-stream, to produce a substantially dry foam.

* * * * *